US007800559B2

(12) United States Patent
Weitbruch et al.

(10) Patent No.: US 7,800,559 B2
(45) Date of Patent: Sep. 21, 2010

(54) METHOD AND APPARATUS FOR POWER LEVEL CONTROL AND/OR CONTRAST CONTROL IN A DISPLAY DEVICE

(75) Inventors: Sébastien Weitbruch, Niedereschach (DE); Dennis Cota, Villingen (DE); Philippe Le Roy, Betton (FR)

(73) Assignee: Thomson Licensing, Boulogne Billancourt (FR)

( * ) Notice: Subject to any disclaimer, the term of this patent is extended or adjusted under 35 U.S.C. 154(b) by 971 days.

(21) Appl. No.: 11/184,214

(22) Filed: Jul. 19, 2005

(65) Prior Publication Data

US 2006/0022915 A1 Feb. 2, 2006

(30) Foreign Application Priority Data

Jul. 29, 2004 (EP) ..... 04291945

(51) Int. Cl.
*G09G 3/30* (2006.01)

(52) U.S. Cl. ..... 345/77

(58) Field of Classification Search ..... 345/77, 345/76, 45, 46, 82, 83, 211, 212, 691; 315/169.3
See application file for complete search history.

(56) References Cited

U.S. PATENT DOCUMENTS 5,093,654 A * 3/1992 Swift et al. ..... 345/76
5,225,906 A * 7/1993 Sin ..... 348/469
5,854,627 A * 12/1998 Kurihara et al. ..... 345/211
6,144,364 A * 11/2000 Otobe et al. ..... 345/691
6,229,583 B1 * 5/2001 Yasunishi ..... 349/33
6,326,938 B1 * 12/2001 Ishida et al. ..... 345/63
6,674,429 B1 * 1/2004 Correa et al. ..... 345/211
7,522,130 B2 * 4/2009 Weitbruch et al. ..... 345/63
2002/0008684 A1 * 1/2002 Udo et al. ..... 345/89
2002/0140659 A1 * 10/2002 Mikami et al. ..... 345/90
2003/0052904 A1 * 3/2003 Gu ..... 345/691
2003/0085905 A1 * 5/2003 Mori et al. ..... 345/589

(Continued)

FOREIGN PATENT DOCUMENTS

EP 1 164 562 A 12/2001

(Continued)

OTHER PUBLICATIONS

Patent Abstract of Japan Search Report, Oct. 10, 2002, Sony Corp.

*Primary Examiner*—Chanh Nguyen
*Assistant Examiner*—Robert M Stone
(74) *Attorney, Agent, or Firm*—Robert D. Shedd; Patricia Verlangieri

(57) ABSTRACT

The present invention relates to a method and an apparatus for controlling the power level and/or the contrast in a display device having a plurality of luminous elements corresponding to the colour components of the pixels of a picture, wherein the luminance generated by each of said luminous element is based on the intensity of the signal supplied to the luminous element and the power level and/or contrast for each picture is controlled by adjusting the intensity of the signal to be supplied to each luminous element. The invention is applicable to organic light emitting displays (OLED). According to the invention, the intensity of the signal to be supplied to each luminous element is based on reference signals and the adjustment of the signal intensity is made by adjusting the level of the reference signals.

10 Claims, 3 Drawing Sheets

U.S. PATENT DOCUMENTS

2003/0189558 A1* 10/2003 Aoki et al. ..... 345/204
2003/0218583 A1* 11/2003 Hasagawa ..... 345/76
2004/0056854 A1* 3/2004 Kondo et al. ..... 345/204
2004/0150660 A1* 8/2004 Abe et al. ..... 345/691
2004/0155593 A1* 8/2004 Kim et al. ..... 315/158
2005/0062691 A1* 3/2005 Tamura et al. ..... 345/76
2005/0225466 A1* 10/2005 Yamaguchi ..... 341/144
2006/0164408 A1* 7/2006 Nishikawa et al. ..... 345/207
2006/0244707 A1* 11/2006 Furihata et al. ..... 345/98
2007/0008251 A1* 1/2007 Kohno et al. ..... 345/76

FOREIGN PATENT DOCUMENTS

EP 1 310 935 5/2003

* cited by examiner

METHOD AND APPARATUS FOR POWER LEVEL CONTROL AND/OR CONTRAST CONTROL IN A DISPLAY DEVICE

This application claims the benefit, under 35 U.S.C. §119 of European Patent Application 04291945.6, filed Jul. 29, 2004.

FIELD OF THE INVENTION

The present invention relates to a method and an apparatus for controlling the power level and/or the contrast in a display device having a plurality of luminous elements corresponding to the colour components of the pixels of a picture, wherein the luminance generated by each of said luminous element is based on the intensity of the signal supplied to the luminous element.

More specifically, the invention is closely related to organic light emitting displays (OLED).

BACKGROUND OF THE INVENTION

A high peak-white luminance is always required to achieve a good contrast ratio in every display technologies even with ambient light conditions and, for every kind of active displays, more peak white luminance corresponds to a higher power that flows in the electronic of the display. Therefore, if no specific management is done, the enhancement of the peak luminance for a given electronic efficacy will introduce an increase of the power consumption.

The main idea behind every kind of power management concept associated with peak white enhancement is based on the variation of the peak-luminance depending on the picture content in order to stabilize the power consumption to a specified value. This concept is shown in FIG. 1. When the picture load is low, the peak luminance is high and when the picture load is high, the peak luminance is low. The concept described on this figure enables to avoid any overloading of the power supply of the display panel as well as a maximum contrast for a given picture.

Such a concept suits very well to the human visual system. When the picture load is low, the contrast ratio is high and when the picture is high, the human eye is dazzled and is less sensitive to contrast ratio. So, for a full-white picture, the contrast ratio can be lower than for a peak-white picture.

In the case of cathode Ray Tubes (CRTs), the power management is based on a so called ABL function (Average Beam-current Limiter), which is implemented by analog means and which decreases video gain as a function of the average luminance of the pictures.

In the case of an organic light-emitting diode display, also called. OLED display, the luminance as well as the power consumption is directly linked to the current that flows through each cell. Currently, there is no power level control means for stabilizing the power consumption to a target value.

In the other hand, in such a display device, the contrast is adjusted by a video scaler acting on the video signal. If the video signal is coded on 8 bits and if the contrast should be reduced by 50%, the video signal is rescaled leading to a video signal with only a 7 bit resolution. So, there is a loss of video resolution.

SUMMARY OF THE INVENTION

The present invention proposes a new method and apparatus for controlling the power level and/or the contrast in display devices having a plurality of luminous elements, wherein the luminance generated by each of said luminous element is based on the intensity of the signal supplied to the luminous element and the power level and/or contrast for each picture is controlled by adjusting the intensity of the signal to be supplied to each luminous element.

The basic idea of this invention is to supply the luminous elements of the display device with a signal whose intensity is based on reference signals and to modify the level of these reference signals for adjusting the intensity of the signals supplied to the luminous elements.

So, the invention relates to a method for controlling the power level and/or the contrast in a display device having a plurality of luminous elements corresponding to the colour components of the pixels of a picture, wherein the luminance generated by each of said luminous elements is based on the intensity of the signal supplied to the luminous element and the power level and/or contrast for each picture is controlled by adjusting the intensity of the signal to be supplied to each luminous element, wherein the intensity of the signal to be supplied to each luminous element is based on reference signals and in that the adjustment of the signal intensity is made by adjusting the level of the reference signals.

By this method, the resolution of the video signal supplied to the luminous elements is not modified.

For controlling the power level, the method further comprises the two following steps:

calculating, for each picture received by the display device, a parameter representative of the power needed by the display device for displaying said picture; this parameter is for example the average power level; and adjusting the intensity of the signal to be supplied to each luminous element in order that the power needed by the display device for displaying said picture is lower than a target value.

For controlling the contrast of the pictures displayed by the display device, the method further comprises the following steps:

calculating an adjustment factor to be applied to the intensity of the picture signal supplied to the luminous elements in order that the resulting contrast is equal to a required contrast, and applying said adjustment factor to said reference signals.

In a preferred embodiment, a non linear transformation is applied to reference signals, before adjustment of the signal intensity, in order to increase the amplitude of the low-amplitude reference signals. To compensate this transformation, the inverse transformation is applied to the picture signal.

The invention concerns also an apparatus for controlling the power level and/or the contrast in a display device having a plurality of luminous elements corresponding to the colour components of the pixels of a picture, wherein the luminance generated by each of said luminous elements is based on the intensity of the signal supplied to the luminous element and the power level and/or contrast for each picture is controlled by adjusting the intensity of the signal to be supplied to each luminous element, wherein the intensity of the signal to be supplied to each luminous element is based on reference signals and in that it comprises adjustment means for modifying the signal intensity by adjusting the level of the reference signals.

For controlling the power level, the apparatus further comprises calculation means for calculating, for each picture received by the display device, a parameter representative of the power needed by the display device for displaying said picture, and in that the adjustment means adjusts the level of the reference signals in order that the power needed by the display device for displaying each picture is lower than a target value. The calculation means calculates for example, for each picture received by the display device, the average power level of said picture.

For controlling the contrast of the pictures displayed by the display device, the apparatus further comprises calculation means for calculating an adjustment factor to be applied to the intensity of the signal supplied to the luminous elements in order that the resulting contrast is equal to a required contrast, and in that the adjustment means applies said adjustment factor to said reference signals.

For these two applications, the apparatus comprises a frame memory for storing a picture before transmitting it to the display device.

In a preferred embodiment, the adjustment means of the apparatus comprises means for applying a non linear transformation to reference signals in order to increase the amplitude of the low-amplitude reference signals and the apparatus comprises means for applying the inverse transformation to the picture signal.

Lastly, the invention concerns also a display device comprising a plurality of organic light emitting diodes, signal processing means for processing the picture signal received by the display device, driving means for driving said plurality of organic light emitting diodes according to the signal processed by the signal processing means, reference signalling means for outputting reference signals to the driving means, and an apparatus as defined above which is integrated to the signal processing means.

BRIEF DESCRIPTION OF THE DRAWINGS

Exemplary embodiments of the invention are illustrated in the drawings and in more detail in the following description.

In the figures.

DETAILED DESCRIPTION OF PREFERRED EMBODIMENTS

Figure 1:
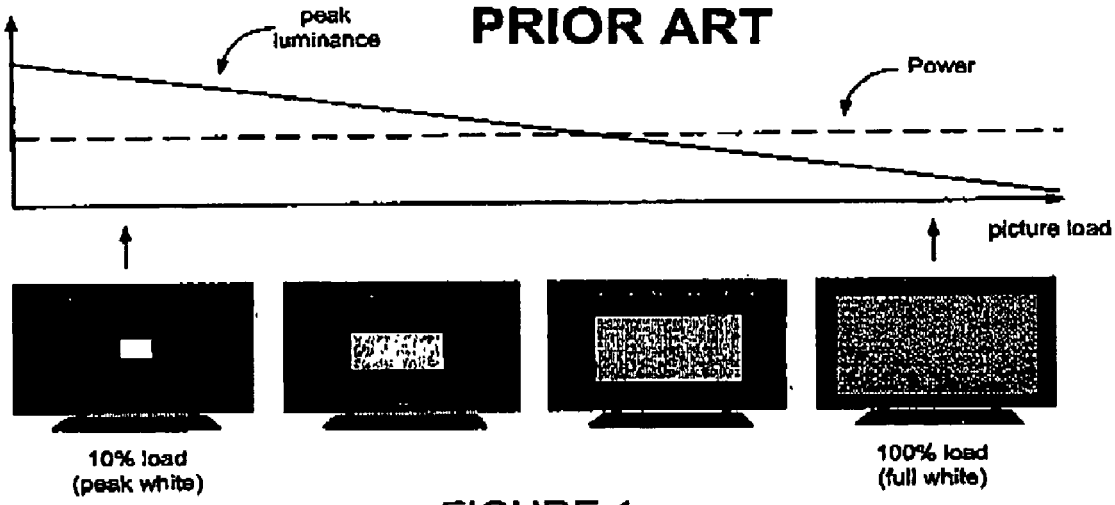
FIG. 1 shows the variation of the peak luminance versus the picture load in a display device.
Figure 2:
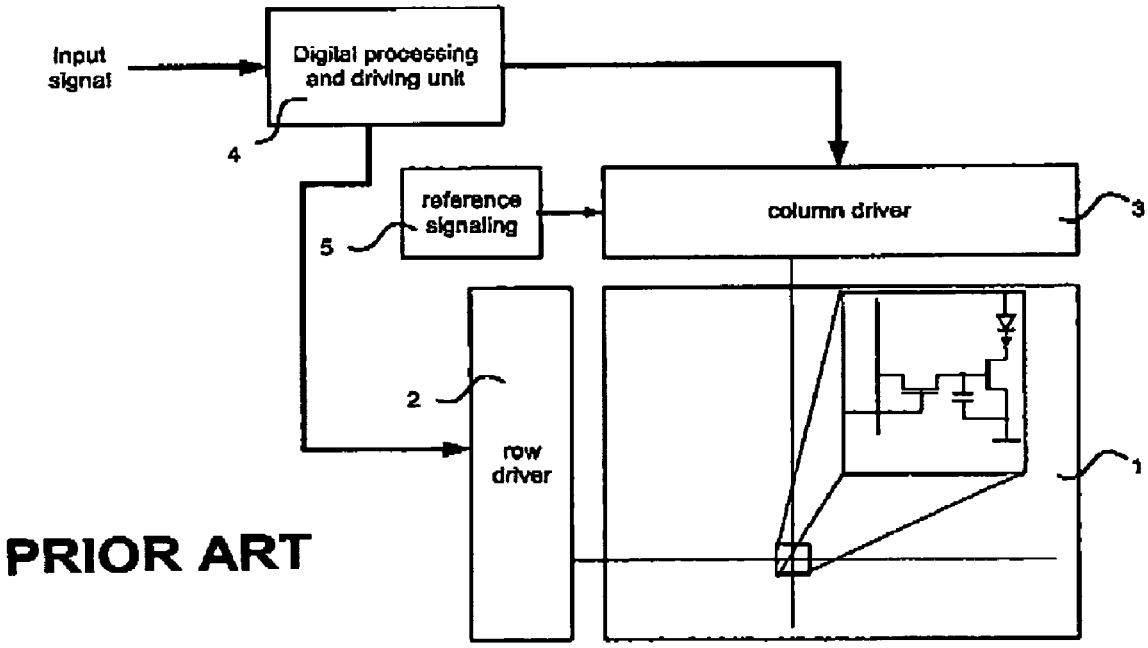
FIG. 2 shows the structure of the control electronic in a OLED display.

The invention is described in relation to a OLED display with an active matrix where each luminous element of the display is controlled via an association of several thin-film transistors (TFTs). The general structure of the electronic for controlling the OLED elements is illustrated by FIG. 2. It comprises:

an active matrix 1 containing, for each OLED element, an association of several thin-film transistors with a capacitor connected to the OLED material of the luminous element; the capacitor acts as a memory component that stores the value of the luminous element during a certain part of the frame; the thin-film transistors act as switches enabling the selection of the luminous element, the storage of the capacitor and the lighting of the luminous element; in the present structure, the value stored in the capacitor determines the luminance produced by the luminous element;

at least one row driver 2 that selects line by line the luminous elements of the display in order to refresh their content, at least one column driver 3 that delivers the value or content to be stored in each luminous element of the current selected line; this component receives the video information for each luminous element;

a digital processing and driving unit 4 that applies required video and signal processing steps to the video input signal and that delivers the required signals to the row and column drivers.

Actually, there are two ways for driving the OLED elements:

in a current driven concept, the digital video information sent by the digital processing and driving unit 4 is converted by the column driver 3 in a current amplitude that is supplied to the luminous element via the active matrix 1;

in a voltage driven concept, the digital video information send by the digital processing and driving unit 4 is converted by the column driver 3 in a voltage amplitude that is supplied to the luminous element via the active matrix 1; but, even so, it should be noticed that an OLED element is a current driven so that each voltage based driving unit is based on a voltage to current converter to achieve appropriate lighting.

The column driver 3 represents, with the digital processing and driving unit 4, the real active part of the electronic and can be considered as a high-level digital to analog converter. The row driver 2 has a quite simple function since it only has to apply a selection line by line. It is more or less a shift register.

The functioning of said electronic is the following: the input video signal is forwarded to the digital processing and driving unit 4 that delivers, after internal processing, a timing signal for row selection to the row driver 2 synchronized with the data sent to the column driver 3. Depending on the used column driver 3, the data are sent either in a parallel way or in a serial way. Additionally, the column driver 3 is equipped with a reference signaling device 5 for delivering reference signals. More precisely, this device delivers a set of reference voltages in case of voltage driven circuitry or a set of reference currents in case of current driven circuitry, the highest reference being used for the highest gray level (white) and the lowest for the smallest gray level. These reference signals are used by the column driver 3 for generating the signal to be supplied to the OLED element.

An example of reference signals is given below for a voltage driven circuitry. Eight reference voltages named $V_0$ to $V_7$ are used V0=3V
V1=2.6V
V2=2.2V
V3=1.4V
V4=0.6V
V5=0.3V
V6=0.16V
V7=0V The different gray levels can be defined as given by the following table. The whole table is given by the annex 1.

| gray level | gray level voltage | Gray level voltage |
|---|---|---|
| 0 | V7 | 0.00 V |
| 1 | V7 + (V6 − V7) × 9/1175 | 0.001 V |
| 2 | V7 + (V6 − V7) × 32/1175 | 0.005 V |
| 3 | V7 + (V6 − V7) × 76/1175 | 0.011 V |

-continued

| gray level | gray level voltage | Gray level voltage |
|---|---|---|
| 4 | V7 + (V6 − V7) × 141/1175 | 0.02 V |
| 5 | V7 + (V6 − V7) × 224/1175 | 0.032 V |
| 6 | V7 + (V6 − V7) × 321/1175 | 0.045 V |
| 7 | V7 + (V6 − V7) × 425/1175 | 0.06 V |
| 8 | V7 + (V6 − V7) × 529/1175 | 0.074 V |
| 9 | V7 + (V6 − V7) × 630/1175 | 0.089 V |
| 10 | V7 + (V6 − V7) × 727/1175 | 0.102 V |
| 11 | V7 + (V6 − V7) × 820/1175 | 0.115 V |
| 12 | V7 + (V6 − V7) × 910/1175 | 0.128 V |
| 13 | V7 + (V6 − V7) × 998/1175 | 0.14 V |
| 14 | V7 + (V6 − V7) × 1086/1175 | 0.153 V |
| 15 | V6 | 0.165 V |
| 16 | V6 + (V5 − V6) × 89/1097 | 0.176 V |
| . | . | . |
| . | . | . |
| . | . | . |
| 252 | V1 + (V0 − V1) × 2549/3029 | 2.937 V |
| 253 | V1 + (V0 − V1) × 2694/3029 | 2.956 V |
| 254 | V1 + (V0 − V1) × 2851/3029 | 2.977 V |
| 255 | V0 | 3.00 V |

Of course, these voltage levels are converted into current before being supplied to the OLED elements. For deducing a luminance value from these voltages, it will be assumed in the rest of the present specification that a 3V voltage applied to an OLED element corresponds to a 400 cd/m$^2$ luminance and that it represents the maximal luminance that can be displayed by the screen of the display device. This value is given as an example.

For a 4/3 screen with a 6.5" (=16.25 cm) diagonal (size=13 cm×9.75 cm) and an efficacy for the OLED material around 14 Cd/A, the surface of the screen is 13×9.75=126.75 cm$^2$ and the current density is 40000/14000=2.86 mA/cm$^2$. So, the total current needed by the panel is 126.75×2.86=362.1 mA.

This current value can be considered as too high. For example, it is sought a maximum current value of 80 mA.

According to the invention, the luminance of the display panel is adjusted in order that the current value necessary for displaying the picture is lower than a maximum current value.

The power of the incoming picture is first evaluated and the luminance of the panel is then adjusted in order to limit the power consumption of the panel to the maximum current value.

A first step of the inventive method consists in evaluating the power of the incoming picture to decide which luminance should be used for a white level. The computation of the picture power is done by computing the Average Power Level (APL) of the picture through the following function:

$$APL(I(x, y)) = \frac{1}{C \times L} \cdot \sum_{x,y} I(x, y)$$

where I(x,y) represents the video level of the pixel with coordinates x, y in the picture, C is the number of elements columns of the screen and L is the number of elements lines of the screen.

In the present specification, the APL value of a picture will be expressed as a percentage of white surface in the picture for clarity and simplicity reasons.

In a second step, the maximal luminance of the screen is determined for different percentages of white surface as shown in the following table. In the case of a maximum current value of 80 mA, the luminance of a full white image (100% white surface) for the above-mentioned 4/3 screen is:

$$80 \cdot \frac{40 \cdot 10^{-3}}{126.75 \cdot 10^{-4}} = 88.363 \text{ cd/m2}.$$

| Surface (white) | Luminance (Cd/m2) | Power (mA) |
|---|---|---|
| 100.00% | 88.363 Cd/m2 | 80.00 mA |
| 97.50% | 90.629 Cd/m2 | 80.00 mA |
| 95.00% | 93.014 Cd/m2 | 80.00 mA |
| 92.50% | 95.527 Cd/m2 | 80.00 mA |
| 90.00% | 98.181 Cd/m2 | 80.00 mA |
| 87.50% | 100.986 Cd/m2 | 80.00 mA |
| 85.00% | 103.956 Cd/m2 | 80.00 mA |
| 82.50% | 107.107 Cd/m2 | 80.00 mA |
| 80.00% | 110.454 Cd/m2 | 80.00 mA |
| 77.50% | 114.017 Cd/m2 | 80.00 mA |
| 75.00% | 117.817 Cd/m2 | 80.00 mA |
| 72.50% | 121.88 Cd/m2 | 80.00 mA |
| 70.00% | 126.233 Cd/m2 | 80.00 mA |
| 67.50% | 130.908 Cd/m2 | 80.00 mA |
| 65.00% | 135.943 Cd/m2 | 80.00 mA |
| 62.50% | 141.381 Cd/m2 | 80.00 mA |
| 60.00% | 147.272 Cd/m2 | 80.00 mA |
| 57.50% | 153.675 Cd/m2 | 80.00 mA |
| 55.00% | 160.66 Cd/m2 | 80.00 mA |
| 52.50% | 168.31 Cd/m2 | 80.00 mA |
| 50.00% | 176.726 Cd/m2 | 80.00 mA |
| 47.50% | 186.027 Cd/m2 | 80.00 mA |
| 45.00% | 196.362 Cd/m2 | 80.00 mA |
| 42.50% | 207.913 Cd/m2 | 80.00 mA |
| 40.00% | 220.907 Cd/m2 | 80.00 mA |
| 37.50% | 235.634 Cd/m2 | 80.00 mA |
| 35.00% | 252.465 Cd/m2 | 80.00 mA |
| 32.50% | 271.886 Cd/m2 | 80.00 mA |
| 30.00% | 294.543 Cd/m2 | 80.00 mA |
| 27.50% | 321.32 Cd/m2 | 80.00 mA |
| 25.00% | 353.452 Cd/m2 | 80.00 mA |
| 22.50% | 392.724 Cd/m2 | 80.00 mA |
| 20.00% | 400.00 Cd/m2 | 72.429 mA |
| 17.50% | 400.00 Cd/m2 | 63.375 mA |
| 15.00% | 400.00 Cd/m2 | 54.321 mA |
| 12.50% | 400.00 Cd/m2 | 45.268 mA |
| 10.00% | 400.00 Cd/m2 | 36.214 mA |
| 7.50% | 400.00 Cd/m2 | 27.161 mA |
| 5.00% | 400.00 Cd/m2 | 18.107 mA |
| 2.50% | 400.00 Cd/m2 | 9.054 mA |

As the luminance is in this example limited to 400 cd/m$^2$, the power consumption for the picture with a white surface percentage inferior to 22% is inferior to 80 mA. The maximal contrast ratio is obtained for a 22% white surface percentage and is equal to 4.5.

According to an important characteristics of the invention, the luminance of the screen is adjusted by modifying the value of the reference levels Vn, n∈ [0, . . . , 7] defined above. The luminance LUM of the screen can be approximated by a quadratic function of the applied voltage V:

$$LUM(x;y)=44\times(V(x;y))^2.$$

This formula is given as an example. The following table gives the different voltage values for the reference voltage V0:

| Surface (white) | V0 | Luminance (Cd/m2) |
|---|---|---|
| 100.00% | 1.41 V | 88.363 Cd/m2 |
| 97.50% | 1.43 V | 90.629 Cd/m2 |
| 95.00% | 1.45 V | 93.014 Cd/m2 |
| 92.50% | 1.47 V | 95.527 Cd/m2 |
| 90.00% | 1.49 V | 98.181 Cd/m2 |

-continued

| Surface (white) | V0 | Luminance (Cd/m2) |
|---|---|---|
| 87.50% | 1.51 V | 100.986 Cd/m2 |
| 85.00% | 1.53 V | 103.956 Cd/m2 |
| 82.50% | 1.55 V | 107.107 Cd/m2 |
| 80.00% | 1.58 V | 110.454 Cd/m2 |
| 77.50% | 1.6 V | 114.017 Cd/m2 |
| 75.00% | 1.63 V | 117.817 Cd/m2 |
| 72.50% | 1.66 V | 121.88 Cd/m2 |
| 70.00% | 1.69 V | 126.233 Cd/m2 |
| 67.50% | 1.72 V | 130.908 Cd/m2 |
| 65.00% | 1.75 V | 135.943 Cd/m2 |
| 62.50% | 1.78 V | 141.381 Cd/m2 |
| 60.00% | 1.82 V | 147.272 Cd/m2 |
| 57.50% | 1.86 V | 153.675 Cd/m2 |
| 55.00% | 1.9 V | 160.66 Cd/m2 |
| 52.50% | 1.95 V | 168.31 Cd/m2 |
| 50.00% | 2.0 V | 176.726 Cd/m2 |
| 47.50% | 2.05 V | 186.027 Cd/m2 |
| 45.00% | 2.1 V | 196.362 Cd/m2 |
| 42.50% | 2.16 V | 207.913 Cd/m2 |
| 40.00% | 2.23 V | 220.907 Cd/m2 |
| 37.50% | 2.3 V | 235.634 Cd/m2 |
| 35.00% | 2.38 V | 252.465 Cd/m2 |
| 32.50% | 2.47 V | 271.886 Cd/m2 |
| 30.00% | 2.58 V | 294.543 Cd/m2 |
| 27.50% | 2.69 V | 321.32 Cd/m2 |

-continued

| Surface (white) | V0 | Luminance (Cd/m2) |
|---|---|---|
| 25.00% | 2.82 V | 353.452 Cd/m2 |
| 22.50% | 2.97 V | 392.724 Cd/m2 |
| 20.00% | 3.0 V | 400.00 Cd/m2 |
| 17.50% | 3.0 V | 400.00 Cd/m2 |
| 15.00% | 3.0 V | 400.00 Cd/m2 |
| 12.50% | 3.0 V | 400.00 Cd/m2 |
| 10.00% | 3.0 V | 400.00 Cd/m2 |
| 7.50% | 3.0 V | 400.00 Cd/m2 |
| 5.00% | 3.0 V | 400.00 Cd/m2 |
| 2.50% | 3.0 V | 400.00 Cd/m2 |

The other reference levels, V1 to V7, can be adjusted in a linear way from the reference level V0. For example, the reference level Vn for a given average power level APL can then be computed as follows:

$$Vn(APL) = \frac{V0(APL) \times Vn(0\%)}{V0(0\%)}$$

The following table gives the voltage values of all the reference levels V0 to V7 for different APL:

| Surface (white) | V0 | V1 | V2 | V3 | V4 | V5 | V6 | V7 |
|---|---|---|---|---|---|---|---|---|
| 100.00% | 1.41 V | 1.22 V | 1.03 V | 0.66 V | 0.28 V | **0.14 V** | **0.08 V** | 0.0 V |
| 97.50% | 1.43 V | 1.24 V | 1.05 V | 0.67 V | 0.29 V | **0.14 V** | **0.08 V** | 0.0 V |
| 95.00% | 1.45 V | 1.25 V | 1.06 V | 0.68 V | 0.29 V | **0.14 V** | **0.08 V** | 0.0 V |
| 92.50% | 1.47 V | 1.27 V | 1.08 V | 0.68 V | 0.29 V | **0.15 V** | **0.08 V** | 0.0 V |
| 90.00% | 1.49 V | 1.29 V | 1.09 V | 0.69 V | 0.3 V | **0.15 V** | **0.08 V** | 0.0 V |
| 87.50% | 1.51 V | 1.31 V | 1.11 V | 0.7 V | 0.3 V | **0.15 V** | **0.08** V | 0.0 V |
| 85.00% | 1.53 V | 1.33 V | 1.12 V | 0.71 V | 0.31 V | **0.15 V** | **0.08 V** | 0.0 V |
| 82.50% | 1.55 V | 1.35 V | 1.14 V | 0.72 V | 0.31 V | 0.16 V | **0.08 V** | 0.0 V |
| 80.00% | 1.58 V | 1.37 V | 1.16 V | 0.74 V | 0.32 V | 0.16 V | **0.08 V** | 0.0 V |
| 77.50% | 1.6 V | 1.39 V | 1.18 V | 0.75 V | 0.32 V | 0.16 V | **0.09 V** | 0.0 V |
| 75.00% | 1.63 V | 1.41 V | 1.19 V | 0.76 V | 0.33 V | 0.16 V | **0.09 V** | 0.0 V |
| 72.50% | 1.66 V | 1.44 V | 1.21 V | 0.77 V | 0.33 V | 0.17 V | **0.09 V** | 0.0 V |
| 70.00% | 1.69 V | 1.46 V | 1.24 V | 0.79 V | 0.34 V | 0.17 V | **0.09 V** | 0.0 V |
| 67.50% | 1.72 V | 1.49 V | 1.26 V | 0.8 V | 0.34 V | 0.17 V | **0.09 V** | 0.0 V |
| 65.00% | 1.75 V | 1.52 V | 1.28 V | 0.82 V | 0.35 V | 0.17 V | **0.09 V** | 0.0 V |
| 62.50% | 1.78 V | 1.55 V | 1.31 V | 0.83 V | 0.36 V | 0.18 V | **0.1 V** | 0.0 V |
| 60.00% | 1.82 V | 1.58 V | 1.34 V | 0.85 V | 0.36 V | 0.18 V | **0.1 V** | 0.0 V |
| 57.50% | 1.86 V | 1.61 V | 1.36 V | 0.87 V | 0.37 V | 0.19 V | **0.1 V** | 0.0 V |
| 55.00% | 1.9 V | 1.65 V | 1.39 V | 0.89 V | 0.38 V | 0.19 V | **0.1 V** | 0.0 V |
| 52.50% | 1.95 V | 1.69 V | 1.43 V | 0.91 V | 0.39 V | 0.19 V | **0.1 V** | 0.0 V |
| 50.00% | 2.0 V | 1.73 V | 1.46 V | 0.93 V | 0.4 V | 0.2 V | **0.11 V** | 0.0 V |
| 47.50% | 2.05 V | 1.77 V | 1.5 V | 0.96 V | 0.41 V | 0.2 V | **0.11 V** | 0.0 V |
| 45.00% | 2.1 V | 1.82 V | 1.54 V | 0.98 V | 0.42 V | 0.21 V | **0.11 V** | 0.0 V |
| 42.50% | 2.16 V | 1.88 V | 1.59 V | 1.01 V | 0.43 V | 0.22 V | **0.12 V** | 0.0 V |
| 40.00% | 2.23 V | 1.93 V | 1.64 V | 1.04 V | 0.45 V | 0.22 V | **0.12 V** | 0.0 V |
| 37.50% | 2.3 V | 2.0 V | 1.69 V | 1.08 V | 0.46 V | 0.23 V | **0.12 V** | 0.0 V |
| 35.00% | 2.38 V | 2.07 V | 1.75 V | 1.11 V | 0.48 V | 0.24 V | **0.13 V** | 0.0 V |
| 32.50% | 2.47 V | 2.14 V | 1.81 V | 1.15 V | 0.49 V | 0.25 V | **0.13 V** | 0.0 V |
| 30.00% | 2.58 V | 2.23 V | 1.89 V | 1.2 V | 0.52 V | 0.26 V | **0.14 V** | 0.0 V |
| 27.50% | 2.69 V | 2.33 V | 1.97 V | 1.26 V | 0.54 V | 0.27 V | **0.14 V** | 0.0 V |
| 25.00% | 2.82 V | 2.45 V | 2.07 V | 1.32 V | 0.56 V | 0.28 V | **0.15 V** | 0.0 V |
| 22.50% | 2.97 V | 2.58 V | 2.18 V | 1.39 V | 0.59 V | 0.3 V | 0.16 V | 0.0 V |
| 20.00% | 3.0 V | 2.6 V | 2.2 V | 1.4 V | 0.6 V | 0.3 V | 0.16 V | 0.0 V |
| 17.50% | 3.0 V | 2.6 V | 2.2 V | 1.4 V | 0.6 V | 0.3 V | 0.16 V | 0.0 V |
| 15.00% | 3.0 V | 2.6 V | 2.2 V | 1.4 V | 0.6 V | 0.3 V | 0.16 V | 0.0 V |
| 12.50% | 3.0 V | 2.6 V | 2.2 V | 1.4 V | 0.6 V | 0.3 V | 0.16 V | 0.0 V |
| 10.00% | 3.0 V | 2.6 V | 2.2 V | 1.4 V | 0.6 V | 0.3 V | 0.16 V | 0.0 V |
| 7.50% | 3.0 V | 2.6 V | 2.2 V | 1.4 V | 0.6 V | 0.3 V | 0.16 V | 0.0 V |
| 5.00% | 3.0 V | 2.6 V | 2.2 V | 1.4 V | 0.6 V | 0.3 V | 0.16 V | 0.0 V |
| 2.50% | 3.0 V | 2.6 V | 2.2 V | 1.4 V | 0.6 V | 0.3 V | 0.16 V | 0.0 V |

Figure 3:
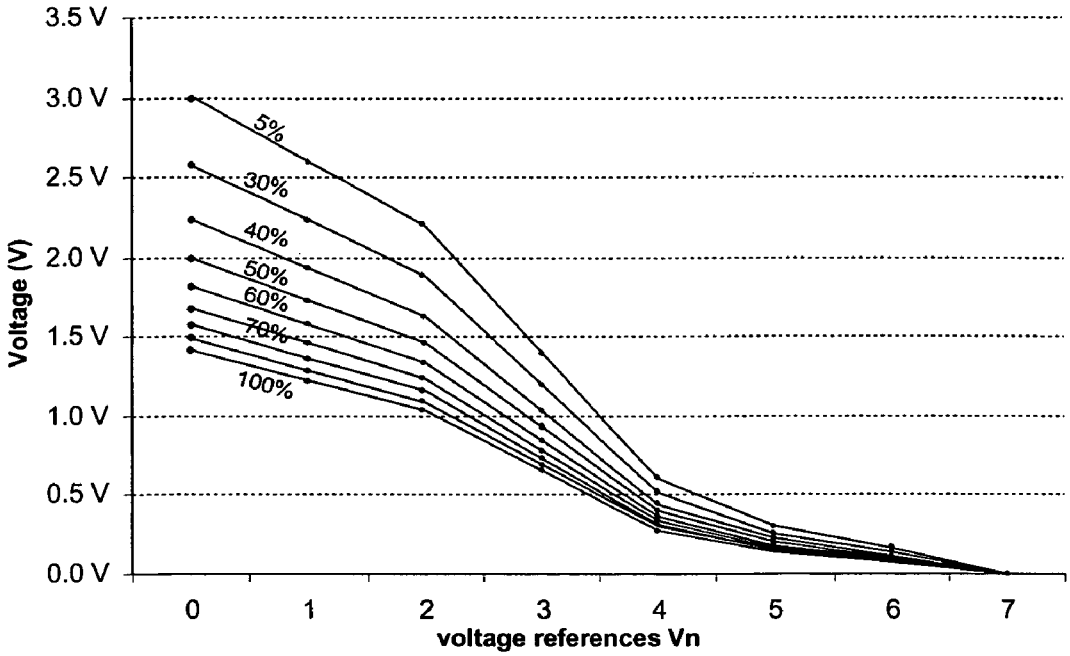
FIG. 3 shows the variations of reference voltages according to picture load in a basic embodiment of the invention.

FIG. 3 shows curves illustrating this table and showing the variations of the reference voltages for the percentages of white surface 5%, 10%, 30%, 40%, 50%, 60%, 70%, 80%, 90% and 100%.

A problem can appear when the voltage references related to the lowest gray levels are very low, which is the case in the above table for the reference voltages V5 and V6 when the picture load is high. Actually, in a voltage driven system, if the voltage is too low, the error (coming from the mismatch between neighbouring luminous elements) becomes higher than the required precision and the information is lost. In a current driven system, the problem is different. In such a system, the lower the current is, the longer it takes to load the capacitance of the luminous element. So, if the required current is too low, the writing time of the luminous element will be too long for a video application.

In the present example, the voltage values below 0.16V (bold values in the above table) can create a precision error. So, as an improvement, it is proposed to modify the reference voltages V1 to V7 in a non-linear way according to the reference level V0. The voltage values for the reference voltage V0 is kept constant while the other ones are modified by a non-linear mathematical transformation f(x,y,z) as followed:

$$Vn(APL)=f(V0(APL);\ Vn(0\%);\ V0(0\%)).$$

Figure 4:
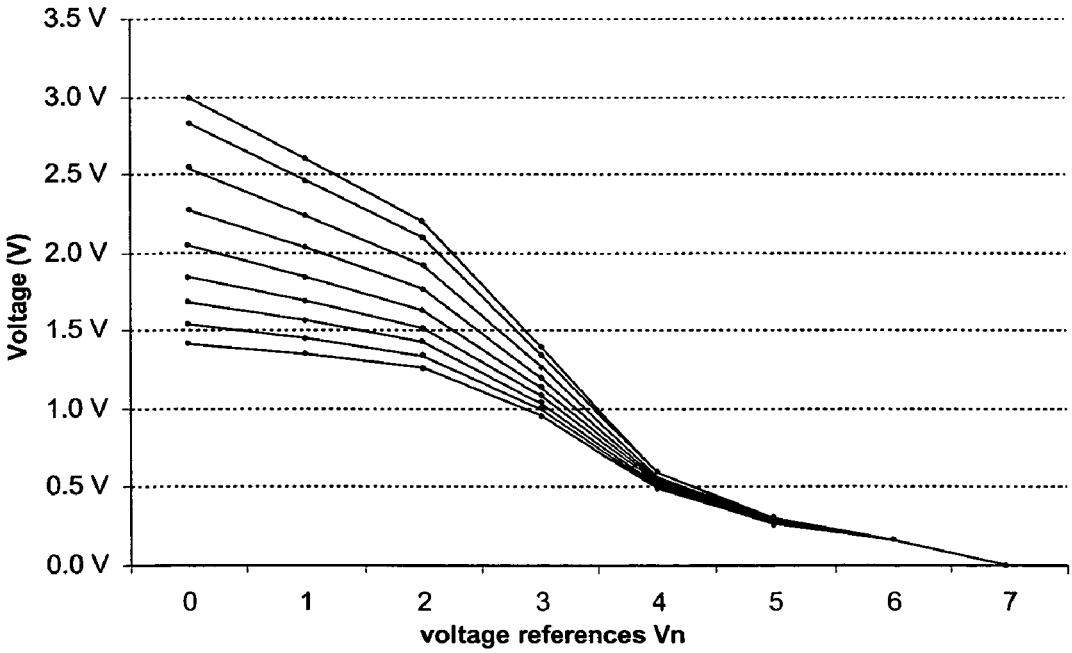
FIG. 4 shows the variations of reference voltages according to picture load in an improved embodiment of the invention.

An example of the result of such a transformation is given in the next table:

FIG. 4, to be compared with FIG. 3, illustrates these new variations of voltage references V0 to V7 by curves. After this transformation, there are almost no more differences for the reference voltages V6 and V7 between the different APL values.

This non linear transformation f applied to the reference voltages V1 to V7 should be compensated by an inverse transformation $f^{-1}$ in the video signal processing chain of the device. With such transformations (f and $f^{-1}$), it is possible to obtain an optimized power management without introducing too much difficulties in the low level gradations (low voltages/low currents).

Figure 5:
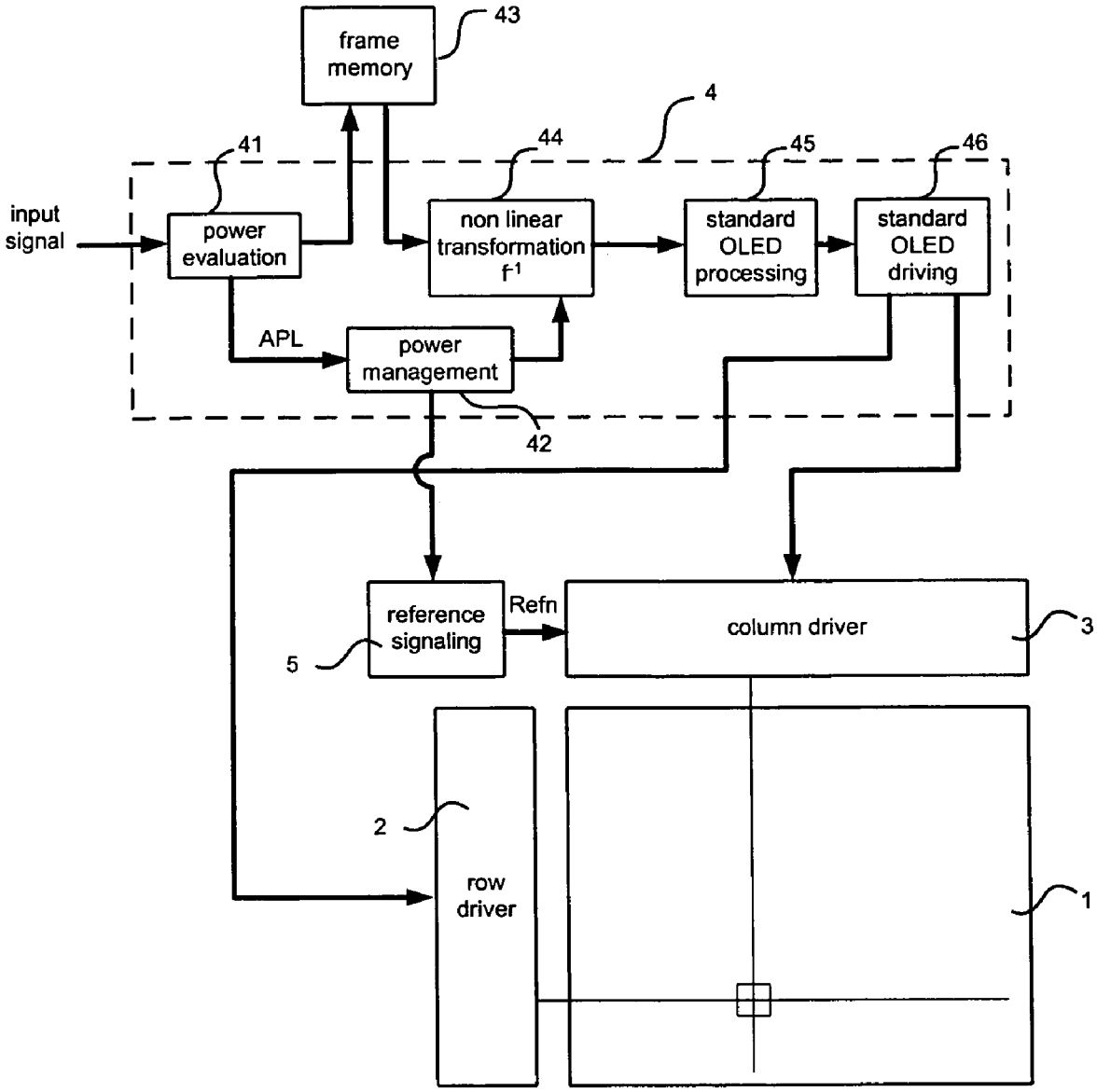
FIG. 5 shows the structure of the control electronic in a OLED display used for implementing the method of the invention.

A circuit implementation of the digital processing and driving unit 4 to be used the power level control method of the invention is given at FIG. 5.

An input picture is forwarded to a power evaluation block 41 that performs the computation of the APL level of the input picture. The APL value is transmitted to a power management block 42. Since the result of this computation can be only made after a complete frame, the input picture should be then stored in a frame memory 43, for example a DDRAM, in order to dispose of one frame delay. This memory can be inside or outside the unit 4.

Based on this APL value, an appropriate set of reference signals Refn is chosen for instance from a Look Up Table and sent to the Reference Signaling Unit 5 via a programming bus.

| Surface (white) | V0 | V1 | V2 | V3 | V4 | V5 | V6 | V7 |
|---|---|---|---|---|---|---|---|---|
| 100.00% | 1.41 V | 1.35 V | 1.26 V | 0.97 V | 0.5 V | 0.27 V | 0.16 V | 0.0 V |
| 97.50% | 1.44 V | 1.38 V | 1.28 V | 0.97 V | 0.5 V | 0.27 V | 0.16 V | 0.0 V |
| 95.00% | 1.47 V | 1.4 V | 1.3 V | 0.98 V | 0.5 V | 0.27 V | 0.16 V | 0.0 V |
| 92.50% | 1.51 V | 1.43 V | 1.32 V | 0.99 V | 0.5 V | 0.27 V | 0.16 V | 0.0 V |
| 90.00% | 1.54 V | 1.45 V | 1.34 V | 1.0 V | 0.51 V | 0.27 V | 0.16 V | 0.0 V |
| 87.50% | 1.57 V | 1.48 V | 1.36 V | 1.01 V | 0.51 V | 0.27 V | 0.16 V | 0.0 V |
| 85.00% | 1.61 V | 1.51 V | 1.38 V | 1.02 V | 0.51 V | 0.27 V | 0.16 V | 0.0 V |
| 82.50% | 1.65 V | 1.54 V | 1.4 V | 1.03 V | 0.51 V | 0.27 V | 0.16 V | 0.0 V |
| 80.00% | 1.68 V | 1.57 V | 1.42 V | 1.04 V | 0.51 V | 0.27 V | 0.16 V | 0.0 V |
| 77.50% | 1.72 V | 1.6 V | 1.45 V | 1.05 V | 0.52 V | 0.27 V | 0.16 V | 0.0 V |
| 75.00% | 1.76 V | 1.63 V | 1.47 V | 1.06 V | 0.52 V | 0.28 V | 0.16 V | 0.0 V |
| 72.50% | 1.81 V | 1.66 V | 1.5 V | 1.07 V | 0.52 V | 0.28 V | 0.16 V | 0.0 V |
| 70.00% | 1.85 V | 1.7 V | 1.52 V | 1.09 V | 0.53 V | 0.28 V | 0.16 V | 0.0 V |
| 67.50% | 1.9 V | 1.73 V | 1.55 V | 1.1 V | 0.53 V | 0.28 V | 0.16 V | 0.0 V |
| 65.00% | 1.94 V | 1.77 V | 1.58 V | 1.11 V | 0.53 V | 0.28 V | 0.16 V | 0.0 V |
| 62.50% | 1.99 V | 1.81 V | 1.61 V | 1.12 V | 0.53 V | 0.28 V | 0.16 V | 0.0 V |
| 60.00% | 2.04 V | 1.85 V | 1.64 V | 1.14 V | 0.54 V | 0.28 V | 0.16 V | 0.0 V |
| 57.50% | 2.1 V | 1.89 V | 1.67 V | 1.15 V | 0.54 V | 0.28 V | 0.16 V | 0.0 V |
| 55.00% | 2.15 V | 1.94 V | 1.7 V | 1.17 V | 0.55 V | 0.28 V | 0.16 V | 0.0 V |
| 52.50% | 2.21 V | 1.98 V | 1.73 V | 1.18 V | 0.55 V | 0.28 V | 0.16 V | 0.0 V |
| 50.00% | 2.27 V | 2.03 V | 1.77 V | 1.2 V | 0.55 V | 0.29 V | 0.16 V | 0.0 V |
| 47.50% | 2.33 V | 2.08 V | 1.81 V | 1.22 V | 0.56 V | 0.29 V | 0.16 V | 0.0 V |
| 45.00% | 2.4 V | 2.13 V | 1.85 V | 1.24 V | 0.56 V | 0.29 V | 0.16 V | 0.0 V |
| 42.50% | 2.47 V | 2.18 V | 1.89 V | 1.25 V | 0.57 V | 0.29 V | 0.16 V | 0.0 V |
| 40.00% | 2.54 V | 2.24 V | 1.93 V | 1.27 V | 0.57 V | 0.29 V | 0.16 V | 0.0 V |
| 37.50% | 2.61 V | 2.29 V | 1.97 V | 1.29 V | 0.57 V | 0.29 V | 0.16 V | 0.0 V |
| 35.00% | 2.68 V | 2.35 V | 2.01 V | 1.31 V | 0.58 V | 0.29 V | 0.16 V | 0.0 V |
| 32.50% | 2.76 V | 2.41 V | 2.06 V | 1.33 V | 0.58 V | 0.3 V | 0.16 V | 0.0 V |
| 30.00% | 2.83 V | 2.47 V | 2.1 V | 1.35 V | 0.59 V | 0.3 V | 0.16 V | 0.0 V |
| 27.50% | 2.9 V | 2.52 V | 2.14 V | 1.37 V | 0.59 V | 0.3 V | 0.16 V | 0.0 V |
| 25.00% | 2.96 V | 2.57 V | 2.18 V | 1.39 V | 0.6 V | 0.3 V | 0.16 V | 0.0 V |
| 22.50% | 3.0 V | 2.6 V | 2.2 V | 1.4 V | 0.6 V | 0.3 V | 0.16 V | 0.0 V |
| 20.00% | 3.0 V | 2.6 V | 2.2 V | 1.4 V | 0.6 V | 0.3 V | 0.16 V | 0.0 V |
| 17.50% | 3.0 V | 2.6 V | 2.2 V | 1.4 V | 0.6 V | 0.3 V | 0.16 V | 0.0 V |
| 15.00% | 3.0 V | 2.6 V | 2.2 V | 1.4 V | 0.6 V | 0.3 V | 0.16 V | 0.0 V |
| 12.50% | 3.0 V | 2.6 V | 2.2 V | 1.4 V | 0.6 V | 0.3 V | 0.16 V | 0.0 V |
| 10.00% | 3.0 V | 2.6 V | 2.2 V | 1.4 V | 0.6 V | 0.3 V | 0.16 V | 0.0 V |
| 7.50% | 3.0 V | 2.6 V | 2.2 V | 1.4 V | 0.6 V | 0.3 V | 0.16 V | 0.0 V |
| 5.00% | 3.0 V | 2.6 V | 2.2 V | 1.4 V | 0.6 V | 0.3 V | 0.16 V | 0.0 V |
| 2.50% | 3.0 V | 2.6 V | 2.2 V | 1.4 V | 0.6 V | 0.3 V | 0.16 V | 0.0 V |

Advantageously, a non-linear transformation f is integrated in these signals. As indicated previously, these reference signals can be reference voltages or reference currents. This programming should occur during the vertical blanking in order not to disturb the displayed picture.

In parallel to that, a non-linear transfer function $f^{-1}$ (it can be a mathematical function or a Look Up Table) which is the inverse of the transformation integrated in the chosen set of reference signals Refn is chosen and is applied to the delayed picture by a block 44. The picture after processing is sent to a standard OLED processing block 45 and then to a standard OLED driving block 46 for finally driving the display with the current picture information.

The method of the invention can be used for controlling the contrast of the pictures displayed by the display device. In that case, the method consists in calculating an adjustment factor that is to be applied to the intensity of the signal supplied to the luminous elements in order to make the contrast go from a present value to a required value. This adjustment factor is then applied to the reference signals.

For example, for reducing the contrast by 50%, the reference signals are decreased from 50%.

ANNEX 1

| | | |
|---|---|---|
| 0 | V7 | 0.00 V |
| 1 | V7 + (V6 − V7) × 9/1175 | 0.001 V |
| 2 | V7 + (V6 − V7) × 32/1175 | 0.004 V |
| 3 | V7 + (V6 − V7) × 76/1175 | 0.01 V |
| 4 | V7 + (V6 − V7) × 141/1175 | 0.019 V |
| 5 | V7 + (V6 − V7) × 224/1175 | 0.03 V |
| 6 | V7 + (V6 − V7) × 321/1175 | 0.043 V |
| 7 | V7 + (V6 − V7) × 425/1175 | 0.057 V |
| 8 | V7 + (V6 − V7) × 529/1175 | 0.071 V |
| 9 | V7 + (V6 − V7) × 630/1175 | 0.084 V |
| 10 | V7 + (V6 − V7) × 727/1175 | 0.097 V |
| 11 | V7 + (V6 − V7) × 820/1175 | 0.11 V |
| 12 | V7 + (V6 − V7) × 910/1175 | 0.122 V |
| 13 | V7 + (V6 − V7) × 998/1175 | 0.133 V |
| 14 | V7 + (V6 − V7) × 1086/1175 | 0.145 V |
| 15 | V6 | 0.157 V |
| 16 | V6 + (V5 − V6) × 89/1097 | 0.167 V |
| 17 | V6 + (V5 − V6) × 173/1097 | 0.177 V |
| 18 | V6 + (V5 − V6) × 250/1097 | 0.186 V |
| 19 | V6 + (V5 − V6) × 320/1097 | 0.194 V |
| 20 | V6 + (V5 − V6) × 386/1097 | 0.202 V |
| 21 | V6 + (V5 − V6) × 451/1097 | 0.21 V |
| 22 | V6 + (V5 − V6) × 517/1097 | 0.217 V |
| 23 | V6 + (V5 − V6) × 585/1097 | 0.225 V |
| 24 | V6 + (V5 − V6) × 654/1097 | 0.233 V |
| 25 | V6 + (V5 − V6) × 723/1097 | 0.241 V |
| 26 | V6 + (V5 − V6) × 790/1097 | 0.249 V |
| 27 | V6 + (V5 − V6) × 855/1097 | 0.257 V |
| 28 | V6 + (V5 − V6) × 917/1097 | 0.264 V |
| 29 | V6 + (V5 − V6) × 977/1097 | 0.271 V |
| 30 | V6 + (V5 − V6) × 1037/1097 | 0.278 V |
| 31 | V5 | 0.285 V |
| 32 | V5 + (V4 − V5) × 60/1501 | 0.298 V |
| 33 | V5 + (V4 − V5) × 119/1501 | 0.31 V |
| 34 | V5 + (V4 − V5) × 176/1501 | 0.322 V |
| 35 | V5 + (V4 − V5) × 231/1501 | 0.334 V |
| 36 | V5 + (V4 − V5) × 284/1501 | 0.345 V |
| 37 | V5 + (V4 − V5) × 335/1501 | 0.356 V |
| 38 | V5 + (V4 − V5) × 385/1501 | 0.366 V |
| 39 | V5 + (V4 − V5) × 434/1501 | 0.376 V |
| 40 | V5 + (V4 − V5) × 483/1501 | 0.387 V |
| 41 | V5 + (V4 − V5) × 532/1501 | 0.397 V |
| 42 | V5 + (V4 − V5) × 580/1501 | 0.407 V |
| 43 | V5 + (V4 − V5) × 628/1501 | 0.417 V |
| 44 | V5 + (V4 − V5) × 676/1501 | 0.427 V |
| 45 | V5 + (V4 − V5) × 724/1501 | 0.438 V |
| 46 | V5 + (V4 − V5) × 772/1501 | 0.448 V |

-continued

| | | |
|---|---|---|
| 47 | V5 + (V4 − V5) × 819/1501 | 0.458 V |
| 48 | V5 + (V4 − V5) × 866/1501 | 0.468 V |
| 49 | V5 + (V4 − V5) × 912/1501 | 0.477 V |
| 50 | V5 + (V4 − V5) × 957/1501 | 0.487 V |
| 51 | V5 + (V4 − V5) × 1001/1501 | 0.496 V |
| 52 | V5 + (V4 − V5) × 1045/1501 | 0.505 V |
| 53 | V5 + (V4 − V5) × 1088/1501 | 0.514 V |
| 54 | V5 + (V4 − V5) × 1131/1501 | 0.523 V |
| 55 | V5 + (V4 − V5) × 1173/1501 | 0.532 V |
| 56 | V5 + (V4 − V5) × 1215/1501 | 0.541 V |
| 57 | V5 + (V4 − V5) × 1257/1501 | 0.55 V |
| 58 | V5 + (V4 − V5) × 1298/1501 | 0.559 V |
| 59 | V5 + (V4 − V5) × 1339/1501 | 0.567 V |
| 60 | V5 + (V4 − V5) × 1380/1501 | 0.576 V |
| 61 | V5 + (V4 − V5) × 1421/1501 | 0.584 V |
| 62 | V5 + (V4 − V5) × 1461/1501 | 0.593 V |
| 63 | V4 | 0.601 V |
| 64 | V4 + (V3 − V4) × 40/2215 | 0.615 V |
| 65 | V4 + (V3 − V4) × 80/2215 | 0.628 V |
| 66 | V4 + (V3 − V4) × 120/2215 | 0.641 V |
| 67 | V4 + (V3 − V4) × 160/2215 | 0.654 V |
| 68 | V4 + (V3 − V4) × 200/2215 | 0.667 V |
| 69 | V4 + (V3 − V4) × 240/2215 | 0.681 V |
| 70 | V4 + (V3 − V4) × 280/2215 | 0.694 V |
| 71 | V4 + (V3 − V4) × 320/2215 | 0.707 V |
| 72 | V4 + (V3 − V4) × 360/2215 | 0.72 V |
| 73 | V4 + (V3 − V4) × 400/2215 | 0.734 V |
| 74 | V4 + (V3 − V4) × 440/2215 | 0.747 V |
| 75 | V4 + (V3 − V4) × 480/2215 | 0.76 V |
| 76 | V4 + (V3 − V4) × 520/2215 | 0.773 V |
| 77 | V4 + (V3 − V4) × 560/2215 | 0.787 V |
| 78 | V4 + (V3 − V4) × 600/2215 | 0.80 V |
| 79 | V4 + (V3 − V4) × 640/2215 | 0.813 V |
| 80 | V4 + (V3 − V4) × 680/2215 | 0.826 V |
| 81 | V4 + (V3 − V4) × 719/2215 | 0.839 V |
| 82 | V4 + (V3 − V4) × 758/2215 | 0.852 V |
| 83 | V4 + (V3 − V4) × 796/2215 | 0.865 V |
| 84 | V4 + (V3 − V4) × 834/2215 | 0.877 V |
| 85 | V4 + (V3 − V4) × 871/2215 | 0.889 V |
| 86 | V4 + (V3 − V4) × 908/2215 | 0.902 V |
| 87 | V4 + (V3 − V4) × 944/2215 | 0.914 V |
| 88 | V4 + (V3 − V4) × 980/2215 | 0.925 V |
| 89 | V4 + (V3 − V4) × 1016/2215 | 0.937 V |
| 90 | V4 + (V3 − V4) × 1052/2215 | 0.949 V |
| 91 | V4 + (V3 − V4) × 1087/2215 | 0.961 V |
| 92 | V4 + (V3 − V4) × 1122/2215 | 0.972 V |
| 93 | V4 + (V3 − V4) × 1157/2215 | 0.984 V |
| 94 | V4 + (V3 − V4) × 1192/2215 | 0.996 V |
| 95 | V4 + (V3 − V4) × 1226/2215 | 1.007 V |
| 96 | V4 + (V3 − V4) × 1260/2215 | 1.018 V |
| 97 | V4 + (V3 − V4) × 1294/2215 | 1.029 V |
| 98 | V4 + (V3 − V4) × 1328/2215 | 1.04 V |
| 99 | V4 + (V3 − V4) × 1362/2215 | 1.052 V |
| 100 | V4 + (V3 − V4) × 1396/2215 | 1.063 V |
| 101 | V4 + (V3 − V4) × 1429/2215 | 1.074 V |
| 102 | V4 + (V3 − V4) × 1462/2215 | 1.085 V |
| 103 | V4 + (V3 − V4) × 1495/2215 | 1.096 V |
| 104 | V4 + (V3 − V4) × 1528/2215 | 1.107 V |
| 105 | V4 + (V3 − V4) × 1561/2215 | 1.118 V |
| 106 | V4 + (V3 − V4) × 1593/2215 | 1.128 V |
| 107 | V4 + (V3 − V4) × 1625/2215 | 1.139 V |
| 108 | V4 + (V3 − V4) × 1657/2215 | 1.149 V |
| 109 | V4 + (V3 − V4) × 1688/2215 | 1.16 V |
| 110 | V4 + (V3 − V4) × 1719/2215 | 1.17 V |
| 111 | V4 + (V3 − V4) × 1750/2215 | 1.18 V |
| 112 | V4 + (V3 − V4) × 1781/2215 | 1.19 V |
| 113 | V4 + (V3 − V4) × 1811/2215 | 1.20 V |
| 114 | V4 + (V3 − V4) × 1841/2215 | 1.21 V |
| 115 | V4 + (V3 − V4) × 1871/2215 | 1.22 V |
| 116 | V4 + (V3 − V4) × 1901/2215 | 1.23 V |
| 117 | V4 + (V3 − V4) × 1930/2215 | 1.24 V |
| 118 | V4 + (V3 − V4) × 1959/2215 | 1.249 V |
| 119 | V4 + (V3 − V4) × 1988/2215 | 1.259 V |
| 120 | V4 + (V3 − V4) × 2016/2215 | 1.268 V |
| 121 | V4 + (V3 − V4) × 2044/2215 | 1.277 V |
| 122 | V4 + (V3 − V4) × 2072/2215 | 1.287 V |
| 123 | V4 + (V3 − V4) × 2100/2215 | 1.296 V |
| 124 | V4 + (V3 − V4) × 2128/2215 | 1.305 V |
| 125 | V4 + (V3 − V4) × 2156/2215 | 1.314 V |

-continued

| | | |
|---|---|---|
| 126 | V4 + (V3 − V4) × 2185/2215 | 1.324 V |
| 127 | V3 | 1.334 V |
| 128 | V3 + (V2 − V3) × 31/2343 | 1.344 V |
| 129 | V3 + (V2 − V3) × 64/2343 | 1.354 V |
| 130 | V3 + (V2 − V3) × 97/2343 | 1.365 V |
| 131 | V3 + (V2 − V3) × 130/2343 | 1.375 V |
| 132 | V3 + (V2 − V3) × 163/2343 | 1.386 V |
| 133 | V3 + (V2 − V3) × 196/2343 | 1.396 V |
| 134 | V3 + (V2 − V3) × 229/2343 | 1.407 V |
| 135 | V3 + (V2 − V3) × 262/2343 | 1.417 V |
| 136 | V3 + (V2 − V3) × 295/2343 | 1.428 V |
| 137 | V3 + (V2 − V3) × 328/2343 | 1.438 V |
| 138 | V3 + (V2 − V3) × 361/2343 | 1.449 V |
| 139 | V3 + (V2 − V3) × 395/2343 | 1.46 V |
| 140 | V3 + (V2 − V3) × 429/2343 | 1.471 V |
| 141 | V3 + (V2 − V3) × 463/2343 | 1.481 V |
| 142 | V3 + (V2 − V3) × 497/2343 | 1.492 V |
| 143 | V3 + (V2 − V3) × 531/2343 | 1.503 V |
| 144 | V3 + (V2 − V3) × 566/2343 | 1.514 V |
| 145 | V3 + (V2 − V3) × 601/2343 | 1.525 V |
| 146 | V3 + (V2 − V3) × 636/2343 | 1.536 V |
| 147 | V3 + (V2 − V3) × 671/2343 | 1.548 V |
| 148 | V3 + (V2 − V3) × 706/2343 | 1.559 V |
| 149 | V3 + (V2 − V3) × 741/2343 | 1.57 V |
| 150 | V3 + (V2 − V3) × 777/2343 | 1.581 V |
| 151 | V3 + (V2 − V3) × 813/2343 | 1.593 V |
| 152 | V3 + (V2 − V3) × 849/2343 | 1.604 V |
| 153 | V3 + (V2 − V3) × 885/2343 | 1.616 V |
| 154 | V3 + (V2 − V3) × 921/2343 | 1.627 V |
| 155 | V3 + (V2 − V3) × 958/2343 | 1.639 V |
| 156 | V3 + (V2 − V3) × 995/2343 | 1.651 V |
| 157 | V3 + (V2 − V3) × 1032/2343 | 1.663 V |
| 158 | V3 + (V2 − V3) × 1069/2343 | 1.674 V |
| 159 | V3 + (V2 − V3) × 1106/2343 | 1.686 V |
| 160 | V3 + (V2 − V3) × 1143/2343 | 1.698 V |
| 161 | V3 + (V2 − V3) × 1180/2343 | 1.71 V |
| 162 | V3 + (V2 − V3) × 1217/2343 | 1.722 V |
| 163 | V3 + (V2 − V3) × 1255/2343 | 1.734 V |
| 164 | V3 + (V2 − V3) × 1293/2343 | 1.746 V |
| 165 | V3 + (V2 − V3) × 1331/2343 | 1.758 V |
| 166 | V3 + (V2 − V3) × 1369/2343 | 1.77 V |
| 167 | V3 + (V2 − V3) × 1407/2343 | 1.782 V |
| 168 | V3 + (V2 − V3) × 1445/2343 | 1.794 V |
| 169 | V3 + (V2 − V3) × 1483/2343 | 1.806 V |
| 170 | V3 + (V2 − V3) × 1521/2343 | 1.819 V |
| 171 | V3 + (V2 − V3) × 1559/2343 | 1.831 V |
| 172 | V3 + (V2 − V3) × 1597/2343 | 1.843 V |
| 173 | V3 + (V2 − V3) × 1635/2343 | 1.855 V |
| 174 | V3 + (V2 − V3) × 1673/2343 | 1.867 V |
| 175 | V3 + (V2 − V3) × 1712/2343 | 1.879 V |
| 176 | V3 + (V2 − V3) × 1751/2343 | 1.892 V |
| 177 | V3 + (V2 − V3) × 1790/2343 | 1.904 V |
| 178 | V3 + (V2 − V3) × 1829/2343 | 1.917 V |
| 179 | V3 + (V2 − V3) × 1868/2343 | 1.929 V |
| 180 | V3 + (V2 − V3) × 1907/2343 | 1.942 V |
| 181 | V3 + (V2 − V3) × 1946/2343 | 1.954 V |
| 182 | V3 + (V2 − V3) × 1985/2343 | 1.966 V |
| 183 | V3 + (V2 − V3) × 2024/2343 | 1.979 V |
| 184 | V3 + (V2 − V3) × 2064/2343 | 1.992 V |
| 185 | V3 + (V2 − V3) × 2103/2343 | 2.004 V |
| 186 | V3 + (V2 − V3) × 2143/2343 | 2.017 V |
| 187 | V3 + (V2 − V3) × 2183/2343 | 2.03 V |
| 188 | V3 + (V2 − V3) × 2223/2343 | 2.042 V |
| 189 | V3 + (V2 − V3) × 2263/2343 | 2.055 V |
| 190 | V3 + (V2 − V3) × 2303/2343 | 2.068 V |
| 191 | V2 | 2.081 V |
| 192 | V2 + (V1 − V2) × 40/1638 | 2.09 V |
| 193 | V2 + (V1 − V2) × 81/1638 | 2.10 V |
| 194 | V2 + (V1 − V2) × 124/1638 | 2.11 V |
| 195 | V2 + (V1 − V2) × 168/1638 | 2.121 V |
| 196 | V2 + (V1 − V2) × 213/1638 | 2.131 V |
| 197 | V2 + (V1 − V2) × 259/1638 | 2.142 V |
| 198 | V2 + (V1 − V2) × 306/1638 | 2.153 V |
| 199 | V2 + (V1 − V2) × 353/1638 | 2.165 V |
| 200 | V2 + (V1 − V2) × 401/1638 | 2.176 V |
| 201 | V2 + (V1 − V2) × 450/1638 | 2.188 V |
| 202 | V2 + (V1 − V2) × 499/1638 | 2.199 V |
| 203 | V2 + (V1 − V2) × 548/1638 | 2.211 V |
| 204 | V2 + (V1 − V2) × 597/1638 | 2.223 V |

-continued

| | | |
|---|---|---|
| 205 | V2 + (V1 − V2) × 646/1638 | 2.234 V |
| 206 | V2 + (V1 − V2) × 695/1638 | 2.246 V |
| 207 | V2 + (V1 − V2) × 745/1638 | 2.258 V |
| 208 | V2 + (V1 − V2) × 795/1638 | 2.27 V |
| 209 | V2 + (V1 − V2) × 846/1638 | 2.282 V |
| 210 | V2 + (V1 − V2) × 897/1638 | 2.294 V |
| 211 | V2 + (V1 − V2) × 949/1638 | 2.307 V |
| 212 | V2 + (V1 − V2) × 1002/1638 | 2.319 V |
| 213 | V2 + (V1 − V2) × 1056/1638 | 2.332 V |
| 214 | V2 + (V1 − V2) × 1111/1638 | 2.345 V |
| 215 | V2 + (V1 − V2) × 1167/1638 | 2.359 V |
| 216 | V2 + (V1 − V2) × 1224/1638 | 2.372 V |
| 217 | V2 + (V1 − V2) × 1281/1638 | 2.386 V |
| 218 | V2 + (V1 − V2) × 1339/1638 | 2.40 V |
| 219 | V2 + (V1 − V2) × 1398/1638 | 2.414 V |
| 220 | V2 + (V1 − V2) × 1458/1638 | 2.428 V |
| 221 | V2 + (V1 − V2) × 1518/1638 | 2.442 V |
| 222 | V2 + (V1 − V2) × 1578/1638 | 2.457 V |
| 223 | V1 | 2.471 V |
| 224 | V1 + (V0 − V1) × 60/3029 | 2.478 V |
| 225 | V1 + (V0 − V1) × 120/3029 | 2.486 V |
| 226 | V1 + (V0 − V1) × 180/3029 | 2.493 V |
| 227 | V1 + (V0 − V1) × 241/3029 | 2.501 V |
| 228 | V1 + (V0 − V1) × 304/3029 | 2.509 V |
| 229 | V1 + (V0 − V1) × 369/3029 | 2.517 V |
| 230 | V1 + (V0 − V1) × 437/3029 | 2.526 V |
| 231 | V1 + (V0 − V1) × 507/3029 | 2.534 V |
| 232 | V1 + (V0 − V1) × 580/3029 | 2.544 V |
| 233 | V1 + (V0 − V1) × 655/3029 | 2.553 V |
| 234 | V1 + (V0 − V1) × 732/3029 | 2.563 V |
| 235 | V1 + (V0 − V1) × 810/3029 | 2.572 V |
| 236 | V1 + (V0 − V1) × 889/3029 | 2.582 V |
| 237 | V1 + (V0 − V1) × 969/3029 | 2.592 V |
| 238 | V1 + (V0 − V1) × 1050/3029 | 2.602 V |
| 239 | V1 + (V0 − V1) × 1133/3029 | 2.613 V |
| 240 | V1 + (V0 − V1) × 1218/3029 | 2.623 V |
| 241 | V1 + (V0 − V1) × 1304/3029 | 2.634 V |
| 242 | V1 + (V0 − V1) × 1393/3029 | 2.645 V |
| 243 | V1 + (V0 − V1) × 1486/3029 | 2.657 V |
| 244 | V1 + (V0 − V1) × 1583/3029 | 2.669 V |
| 245 | V1 + (V0 − V1) × 1686/3029 | 2.682 V |
| 246 | V1 + (V0 − V1) × 1794/3029 | 2.695 V |
| 247 | V1 + (V0 − V1) × 1907/3029 | 2.71 V |
| 248 | V1 + (V0 − V1) × 2026/3029 | 2.724 V |
| 249 | V1 + (V0 − V1) × 2150/3029 | 2.74 V |
| 250 | V1 + (V0 − V1) × 2278/3029 | 2.756 V |
| 251 | V1 + (V0 − V1) × 2411/3029 | 2.773 V |
| 252 | V1 + (V0 − V1) × 2549/3029 | 2.79 V |
| 253 | V1 + (V0 − V1) × 2694/3029 | 2.808 V |
| 254 | V1 + (V0 − V1) × 2851/3029 | 2.828 V |
| 255 | V0 | 2.85 V |

What is claimed is:

1. Method for controlling the power level and/or the contrast in a display device having a plurality of luminous elements corresponding to the colour components of the pixels of a picture, wherein the luminance generated by each of said luminous elements is based on the intensity of picture signals supplied to the luminous element and the power level and/or contrast for each picture is controlled by adjusting the intensity of the picture signals to be supplied to each luminous element, and wherein the intensity of the picture signals to be supplied to the luminous elements is based on a plurality of analog reference signals characterized in that the power level and/or contrast is controlled by adjusting the intensity of the said analog reference signals based on an average power level of said picture and wherein a non linear transformation is applied to the reference levels and an inverse transformation is applied to the picture signal for using instead of reference levels below a predetermined value, said predetermined value or a value above said predetermined value for said analog reference signals to avoid reference levels having a value between zero and the predetermined value and to adapt further reference levels related to a certain percentage of white surface in the picture to avoid precision errors when the picture load is high and to provide continuously increasing gray levels;

wherein the display device is an organic light emitting display.

2. Method according to claim 1, further comprising the following steps for controlling the contrast of the pictures displayed by the display device:

calculating an adjustment factor to be applied to the intensity of the picture signal supplied to the luminous elements in order that the resulting contrast is equal to a required contrast, and applying said adjustment factor to the said analog reference signals provided by modified reference levels modified to avoid reference levels having a value different from zero and below a predetermined value by using instead of said values at least a value corresponding to or above said predetermined value and by using also modified reference levels for reference levels above said predetermined value to adapt further reference levels related to a certain percentage of white surface in the picture to provide continuously increasing gray levels.

3. Method according to claim 1, wherein, before adjustment of the signal intensity, a non linear transformation is applied to the plurality of analog reference signals in order to increase the amplitude of the low-amplitude reference signals and in that the inverse transformation is applied to the picture signal for adjusting the intensity of the signals to be supplied to each luminous element.

4. Method according to claim 1, wherein the luminous elements are organic light emitting display diodes.

5. Method according to claim 1, wherein the analog reference signals are reference voltages or reference currents.

6. Apparatus for controlling the power level and/or the contrast in a display device having a plurality of luminous elements corresponding to the colour components of the pixels of a picture, wherein the luminance generated by each of said luminous elements is based on the intensity of picture signals supplied to the luminous element and the power level and/or contrast for each picture is controlled by adjusting the intensity of the picture signals to be supplied to each luminous element, and wherein the intensity of the picture signals to be supplied to the luminous elements is based on a plurality of analog reference signals wherein an adjustment means controls the power level and/or contrast by adjusting the intensity of the reference signals based on an average power level of said picture and wherein a non linear transformation is applied to the reference levels, provided by a reference signalling unit, for providing instead of reference levels below a predetermined value, said predetermined value or a value above said predetermined value avoiding reference levels having a value above zero and below the predetermined value and means for applying an inverse transformation to the picture signal are provided to avoid precision errors when the picture load is high and to provide continuously increasing gray levels;

wherein the display device is an organic light emitting display.

7. Apparatus according to claim 6, further comprising, for controlling the contrast of the pictures displayed by the display device, a calculation means for calculating an adjustment factor to be applied to the intensity of the picture signal supplied to the luminous elements in order that the resulting contrast is equal to a required contrast, and in that the adjustment means applies said adjustment factor to the analog reference signals provided by a reference signalling unit for providing modified reference levels avoiding reference levels having a value between zero and a predetermined value by using instead of said values reference levels corresponding to or above said predetermined value and for providing also modified reference levels for reference levels above said predetermined value to adapt further reference levels related to a certain percentage of white surface in the picture for providing continuously increasing gray levels.

8. Apparatus according to claim 6, further comprising a frame memory for storing a picture before transmitting it to the display device and for applying a transformation to the picture signal inverse to a non linear transformation applied to reference signals in order to increase the amplitude of the low-amplitude reference signals below or equal to the predetermined value.

9. Apparatus according to claim 6, wherein the adjustment means comprises means for applying a non linear transformation to reference signals and in that it comprises means for applying the inverse transformation to the picture signal.

10. Display device comprising a plurality of organic light emitting diodes, signal processing means for processing a picture signal received by the display device, driving means for driving said plurality of organic light emitting diodes according to the picture signal processed by the signal processing means, reference signalling means for outputting analog reference signals to the driving means, wherein said signal processing means comprises an apparatus according to claim 6.

* * * * *